US005443163A

United States Patent [19]

Mogensen

[11] Patent Number: 5,443,163

[45] Date of Patent: Aug. 22, 1995

[54] APPARATUS FOR SCREENING GRANULAR MATERIALS

[75] Inventor: Peder Mogensen, Hjo, Sweden

[73] Assignee: Fredrik Mogensen AB, Hjo, Sweden

[21] Appl. No.: 211,275

[22] PCT Filed: Sep. 24, 1992

[86] PCT No.: PCT/SE92/00662

§ 371 Date: Apr. 18, 1994

§ 102(e) Date: Apr. 18, 1994

[87] PCT Pub. No.: WO93/05892

PCT Pub. Date: Jan. 4, 1993

[30] Foreign Application Priority Data

Sep. 27, 1991 [EP] European Pat. Off. ..... 91850236

[51] Int. Cl.[6] ..... B07B 1/28

[52] U.S. Cl. ..... 209/315; 209/366.5

[58] Field of Search ..... 209/315, 319, 366, 366.5, 209/365.3

[56] References Cited

U.S. PATENT DOCUMENTS

| | | | |
|---|---|---|---|
| 2,076,348 | 4/1937 | Petersen | 209/329 |
| 3,468,418 | 9/1969 | Renner | 209/315 |
| 3,703,236 | 11/1972 | Spurlin et al. | 209/326 |
| 3,710,940 | 1/1973 | Mogensen | 209/315 |
| 4,057,492 | 11/1977 | Stasinski et al. | 209/366.5 |
| 4,107,035 | 8/1978 | Foresman | 209/315 |
| 4,340,469 | 7/1982 | Archer | 209/315 |
| 4,351,719 | 9/1982 | Morey | 209/315 |
| 4,402,826 | 9/1983 | Uchitel et al. | 209/366.5 |
| 5,037,535 | 8/1991 | Brüderlein | 209/366.5 |

*Primary Examiner*—Andres Kashnikow
*Assistant Examiner*—Lisa Douglas
*Attorney, Agent, or Firm*—Cowan, Liebowitz & Latman

[57] ABSTRACT

This invention concerns an apparatus and method for separating particles according to size, shape, and/or density. The apparatus includes a single vibrating mechanism and a frame forming a vibrating space having classifying elements in the form of cloths, wires or bars, slopingly arranged in the space, one below the other. A collection of particles is fed through an inlet into the space, wherein the vibrating means is mounted in a transversal structure of the frame and is arranged below the inlet and well to the rear of the center of gravity of the apparatus relative to the direction of particle flow. The inlet is moved with a stroke which is more than twice as large as the motion at the center of gravity.

4 Claims, 3 Drawing Sheets

APPARATUS FOR SCREENING GRANULAR MATERIALS

APPARATUS FOR SCREENING GRANULAR MATERIALS

The present invention relates to vibrating screening apparatuses, which handle the material to be screened in a mainly vertical loose flow—in the following called Sizers. An example of such a Sizer is described, e.g. in the U.S. Pat. No. 3,710,940. In that case the loose flow of particles is created by the apertures of the classifying elements, below called screen cloths, being larger than the particles arriving on them. A loose flow of particles can also be achieved when a minor portion of them are larger than these apertures.

Conventional screening apparatuses have screen cloths where the apertures are usually smaller than a greater portion of the particles. In such a case it is much more difficult for the particles to pass the screen cloth: the particles form a bed on top of the screen cloth, which obstructs the movement of the particles. Particles, which have nearly the same size as the apertures may get stuck in the screen cloth.

Sizers depend upon the formation of such beds of particles being avoided as far as possible; by using several layers of often steeply sloping screen cloths, satisfactory separations are obtained, despite the apertures being large in relation to the separation size.

In practice, however, Sizers do suffer from beds being formed, normally when the flow of particles meets the first part of the screen cloths, where the flow is relatively concentrated. If such a bed is allowed to spread over a substantial segment of the screen cloth, the danger of reduced screening efficiency becomes imminent in that the congestin of the bed prevents the finer particles from working their way down through the screen cloths; they contaminate the coarser products.

The object of the present invention is to prevent the formaton of such beds, or, to segregate the particles in the beds.

This is achieved by the movement being more vigorous and basically perpendicular to the surface of the screen cloths at the inlet end of the Sizer, close to the first parts of the screen cloths, so that it agitates and segregates the flow of particles in this region, according to the characterizing parts of the claims.

The motion of Sizer has so far been linear and of approximately the same attitude (stroke, direction and frequency) over the entire Sizer. Such a vibration is normally created by two vibrator motors or eccentric elements, where the eccenters rotate in opposite directions, or by a linear magnetic vibrator.

The movement of the Sizer, according to this invention, must not be uniform. At the initial part of the screen cloths, it should be vigorous and approximately perpendicular to the surface of them so that the segregating action is enhanced. An elliptic motion could be advantageous, in that its direction of rotation can be varied, according to the screening duty. This motion has not the same impact as a linear motion and could, therefore, be larger and more effective.

Towards the outlet end of the Sizer, where the particles leave it, a more transporting and less agitating movement is to be preferred; it should be more horizontal, having a direction with an acute angle, relative to the surface of the screen cloths.

The invention will be described by way of examples with reference to the drawings:

FIG. 1 illustrates the principle of the invention;

FIG. 2 schematically illustrates a Sizer according to the invention in longitudinal section;

Figure 8:
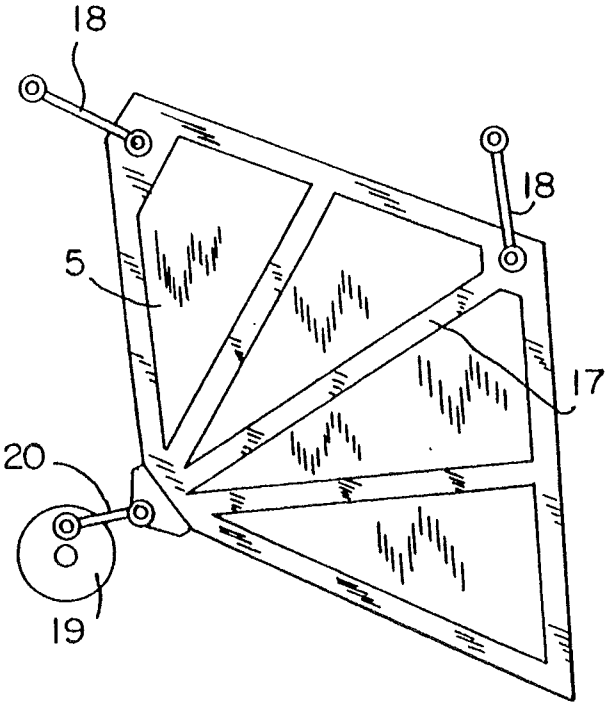
Figure 7:
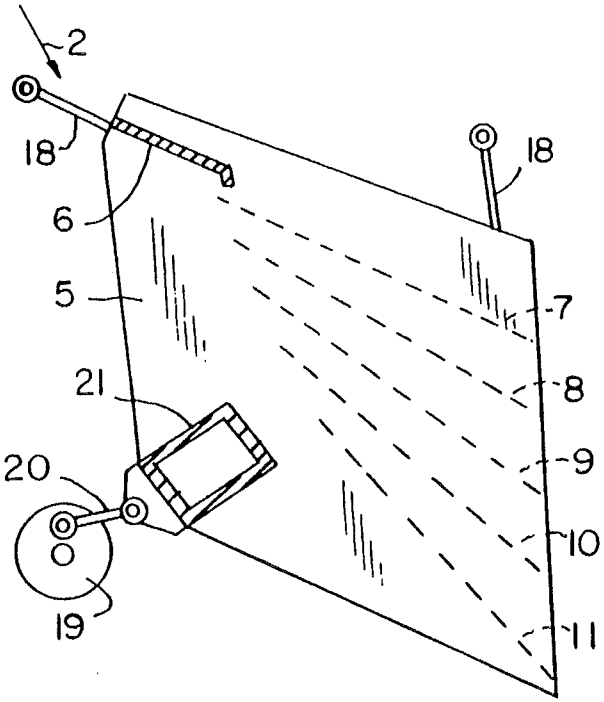

FIG. 7 schematically illustrates another embodiment of the invention in the longitudinal section;

FIG. 8 illustrates an external side view of the embodiment shown in FIG. 7.

Figure 1:
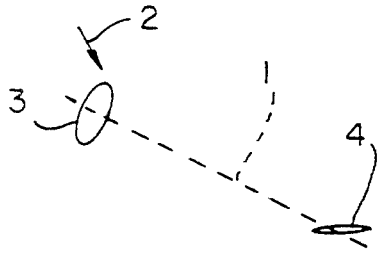

FIG. 1 illustrates the principle. 1 is a screen cloth, seen from the side. 2 indicates the general direction of the flow of particles arriving on the screen cloth. The primary part of the screen cloth, near its inlet end, moves, more or less, perpendicularly to its surface, in the figure illustrated by the ellipse 3, while the secondary part of the screen cloth, near its outlet end, moves almost linearly, at an angle, as indicated by the ellipse 4.

Such movements can be for example created by means of mounting the Sizer and/or the screen cloth in a suspension system, which restricts the motion by means of links, leaf springs or other types of guides, the position of the vibrator motor not being critical.

Another way to achieve the desired movement is to use one vibrator motor located underneath the inlet of the Sizer and well to the rear of its centre of gravity, relative to the direction of the flow of particles. By arranging the vibrator in this fashion and suspending the Sizer by means of springs, its perpendicular stroke at the inlet end becomes very much larger than, say, that at the centre of gravity, which further enhances the vigorous action. The position of the vibrator motor in the Sizer is critical.

When operating a Sizer with one vibrator motor, the position of the vibrator in relation to the Sizer's centre of gravity, as well as the Sizer's rotational inertia, are important factors influencing its movement. Sometimes it is necessary to equip a Sizer with accessories of such considerable weight or location athat the centre of gravity becomes very much displaced. This way have to be compensated by adding motion restricting guides, as mentioned above, or by fixing the vibrator in a different position; alternative vibrator locations could be a standard feature.

The same criteria would apply, e.g., with wider Sizers which need more than one vibrator motor, if their shafts are in line and the vibrators have the same setting and direction of rotation.

A series of comparative tests has been made, where dry sand 0–8 mm was separated at 0.25, 0.5, 1, 2 and 4 mm, by means of a Sizer with 5 screen cloths. The Sizer was driven by either two vibrators or by one vibrator, according to the invention.

The stroke of the 2-vibrator unit was uniform, with the same magnitude as the stroke at the 1-vibrator unit's centre of gravity. The inlet end of the 1-vibrator unit had an elliptical motion, which was more than twice as large as the motion of the 2-vibrator unit.

No other parameters were changed, but several feed rates were tried and the obtained products analyzed. The developments of two features were plotted in diagrams. One was the cleanliness, i.e., the amount of the total feed that was brought to the respective products and being within the desired size limits. The other was the recovery or the mean value of the amount of each particle size range that was recovered in the respective product, e.g. the amount of <0.25 mm that ended up in the fines through the bottom screen cloth.

Figure 5:
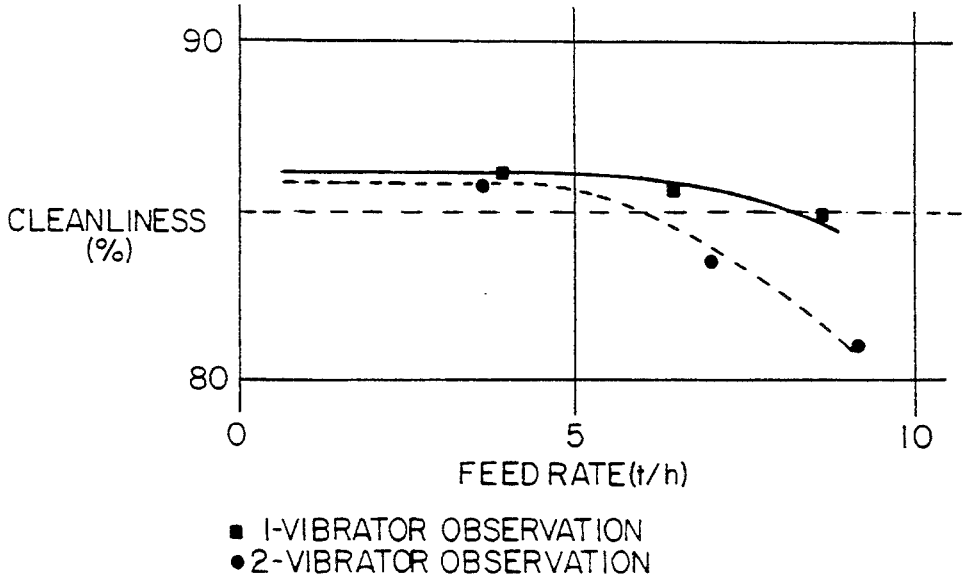
FIGS. 5 and 6 are diagrams showing the development of the cleanliness and recovery respectively.
Figure 6:
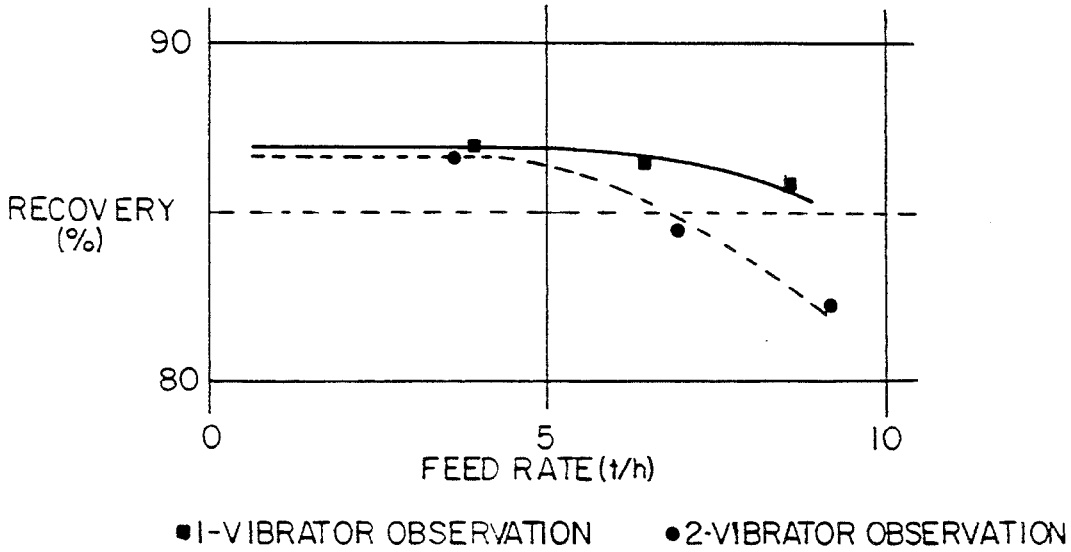

FIG. 5 shows the development of the cleanliness and FIG. 6 that of the recovery. Initially the 2-vibrator and the 1-vibrator cases are nearly similar, but when the feed rate exceeds some 5 t/h the 1-vibrator unit manages with less deterioration. For instance, at about 8 t/h the 1-vibrator unit has the same cleanliness (85%) as the 2-vibrator unit at about 6 t/h.

Another series of comparative tests were made with the same Sizer, again being driven by either two vibrators or by one vibrator. The Sizer was fed with an excessive rate of dry, natural sand, which is known to have a strong tendency to get stuck in the meshes of screen cloths. After a certain time, the test was stopped and one particular screen cloth was investigated. Three separate surfaces were defined and the number of stuck particles in them was counted. The case with one vibrator had an average of 50% less stuck particles.

Other advantages of using one vibrator instead of two are that the production and energy costs are reduced and the risk of running the Sizer with two vibrators incorrectly—either with the vibrators having different settings, or rotation, or one vibrator standing still—is largely eliminated.

Figure 2:
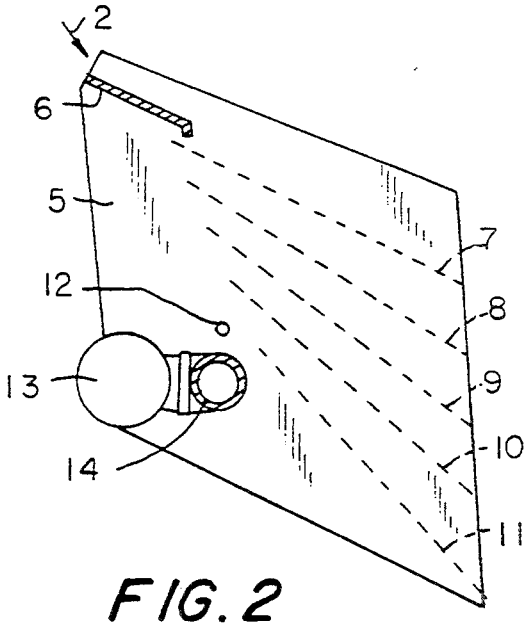
Figure 3:
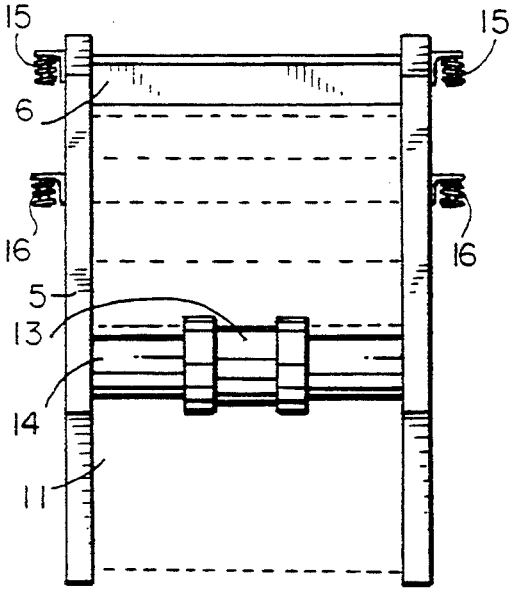
FIG. 3 illustrates the Sizer seen from the rear end.
Figure 4:
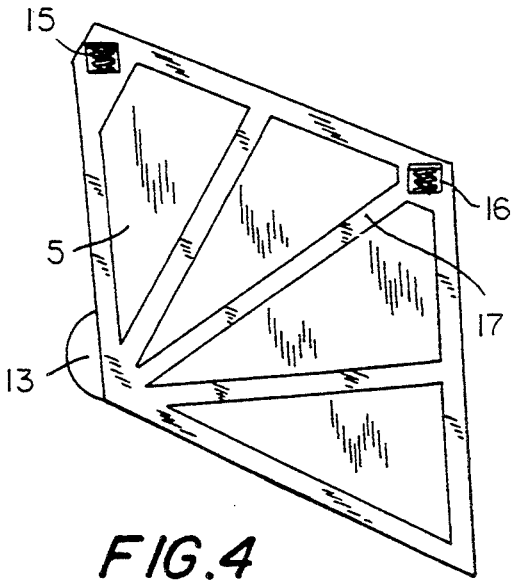
FIG. 4 illustrates an external side view of the invention.

Referring to FIGS. 2–4 the Sizer consists of a frame 5, which has a feed plate 6 at the upper rear, or inlet end, where the flow of material enters the apparatus, as illustrated by the arrow 2. A number of screen cloths 7, 8,9,10 and 11, are slopingly arranged inside the frame 5, one below the other. An eccentric vibrator motor 13 is mounted on a transversal structure 14, which is located underneath the feed plate 6, to the rear of the centre of gravity 12 of the Sizer. This location gives the motion as shown in FIG. 1, described above.

The Sizer is suspended on helical rear springs 15 and helical front springs 16. The side walls of the frame 5 are reinforced by beams, an example of which is identified by 17. The finest particles leave the Sizer after having passed the bottom screen cloth 11, while larger particles only to varying degrees manage to pass the screen cloths and are moved out of the Sizer, to the right in the drawing.

If the vibrator motor were located in the centre of gravity, the entire machine would have an almost circular motion, and the desired effect would not be achieved. If the vibrator motor was located on top or forward of the centre of gravity, the movement would be more uniform or even counter productive in that the inlet section may only have a transporting movement.

Another example of the invention is shown schematically in FIG. 7, which is a longitudinal section of the machine, and in FIG. 8, which is an external side view of the machine.

The Sizer consists of a frame 5, which is agitated by a vibration generating device, here consisting of a flywheel 19 and a piston 20. It should be mentioned that this device could be almost any kind of vibrator, or vibrators. The Sizer is reinforced by a transversal beam 21. The movement of the Sizer is here mechanically guided by swinging brackets 18. The free ends of the brackets are to be mounted in fixed points, which could be placed in different positions. It should be emphasized, that these brackets illustrate the principle of forced control of the movement only; their location, shape and number could be very different.

Similar to the unit in FIG. 5, the Sizer here has a feed plate 6 and screen cloths 7,8,9,10 and 11. Suspension springs, as in FIG. 4, are not shown. It should be underlined that the features of the invention could be obtained in different ways and with different devices and linear magnetic motors could also be used.

Comparative studies, as described above, have so far only been made with Sizers, but it is believed that similar, beneficial effects would be achieved with conventional screens, using the same motion.

I claim:

1. Apparatus for separating a collection of particles according to size, shape and/or density comprising a single vibrating means and a frame forming a vibrating space having classifying elements in the form of cloths, wires or bars, slopingly arranged in said space, one below the other, a collection of particles being fed through an inlet into said space, wherein said vibrating means is mounted on a transversal structure of said frame and is arranged below said inlet and well to the rear of the center of gravity of the apparatus relative to the direction of particle flow, thereby moving said inlet with a stroke which is more than twice as large as the motion at said center of gravity.

2. The apparatus of claim 1, wherein said transversal structure is a transversal tube.

3. The apparatus of claim 1, wherein there is a suspension system in the form of brackets mechanically guiding the movements of the classifying elements.

4. The apparatus of claim 1, wherein said vibrating means have alternative locations to compensate for the center of gravity being displaced by accessories fitted to the apparatus.

* * * * *